US005630312A

United States Patent [19]

Ballard et al.

[11] Patent Number: 5,630,312

[45] Date of Patent: May 20, 1997

[54] EJECTION MECHANISM FOR ENVELOPE INSERTING MACHINE

[75] Inventors: Michael D. Ballard, Sandy Hook; Joseph H. Marzullo, Brookfield, both of Conn.

[73] Assignee: Pitney Bowes Inc., Stamford, Conn.

[21] Appl. No.: 580,414

[22] Filed: Dec. 28, 1995

[51] Int. Cl.[6] ..... B65B 43/26; B65B 43/28; B65B 43/42

[52] U.S. Cl. ..... 53/569; 53/284.3; 53/381.5

[58] Field of Search ..... 53/569, 284.3, 53/381.5, 381.7, 389.4, 389.5

[56] References Cited

U.S. PATENT DOCUMENTS

| | | | |
|---|---|---|---|
| 1,754,831 | 4/1930 | Marsh . | |
| 3,193,983 | 7/1965 | Wells | 53/117 |
| 3,747,297 | 7/1973 | Hankins | 53/381 R |
| 4,846,455 | 7/1989 | Hurst | 271/2 |
| 4,852,334 | 8/1989 | Auerbach | 53/569 |
| 5,081,825 | 1/1992 | Mrozinski | 53/569 |
| 5,168,689 | 12/1992 | Macelis | 53/569 |
| 5,191,751 | 3/1993 | Marzullo et al. | 53/569 |
| 5,255,498 | 10/1993 | Hotchkiss et al. | 53/569 |
| 5,327,705 | 7/1994 | DeFigueiredo | 53/569 |
| 5,517,797 | 5/1996 | Ballard et al. | 53/569 X |

*Primary Examiner*—Horace M. Culver

*Attorney, Agent, or Firm*—Melvin J. Scolnick; Robert H. Whisker

[57] ABSTRACT

An envelope ejecting apparatus is disclosed for use in an inserting machine in which envelopes are fed successively in one direction along a feed path to a first location and then are moved incrementally in a reverse direction to an insert receiving position at which envelope throat opening devices open the throats of the envelopes so that insert material can be fed thereinto. The envelope ejecting apparatus is connected to the throat opening devices for operation therewith and also to the means for feeding the envelopes in the reverse direction, and there is a control means operatively interconnected between the envelope throat opening means and the envelope ejecting means for preventing the envelope ejecting means from ejecting the envelope until it is positioned at the insert receiving position and insert material has been inserted thereinto.

10 Claims, 5 Drawing Sheets

EJECTION MECHANISM FOR ENVELOPE INSERTING MACHINE

CROSS REFERENCE TO OTHER APPLICATIONS

This application discloses and claims an improvement to the Envelope Positioning Apparatus for Inserting Machine disclosed and claimed in U.S. patent application Ser. No. 356,742, filed on Dec. 15, 1994, and now U.S. Pat. No. 5,517,797, and assigned to the assignee of this application.

BACKGROUND OF THE INVENTION

The present invention relates generally to the field of envelope inserting machines, and more particularly to an envelope ejection mechanism for such machines which ejects envelopes after completion of the operation that places insert material into the envelopes.

Envelope inserting machines, sometimes referred to as envelope stuffing machines, have long been well known and have been well received in various type of business operations which involve some form of high volume mailing, although in recent years some envelope inserting machines have been designed and produced for what would be considered medium volume mailing operations. Some examples of high volume mailing operations where the present invention would find utility are various types of customer billing operations, such as bank credit, major oil company credit cards, department store charge cards, sweepstakes operations, various forms of mass mailing advertising, and myriad other operations where various items of material are inserted into an envelope for an addressee.

In a typical inserting operation, a package of insert material may include a customer bill, an advertising circular or flyer, a promotional coupon and a return envelope for the customer's convenience in paying his bill. These items are typically stored in the storage trays of a collating machine and are fed serially onto a conveyor to a location where they are stacked in a desired manner and formed into the insert package, which is then fed to a standby location in an envelope inserting machine, which may be a separate module or may be physically incorporated into the collating machine. In either event, a plurality of envelopes are stored in a storage tray of the envelope machine, and a suitable conveying mechanism conveys them seriatim to a location where packages of insert material are to be inserted into successive envelopes. The inserting machine typically includes an envelope throat opening mechanism by which the upper free edge of the envelope is spread away from the adjacent edge to which the envelope flap is attached to provide sufficient space for the package of insert material to be inserted into the envelope by a suitable inserting mechanism, such as by cooperating feed rollers or rollers and belts which engage the package of insert material to feed it into the envelope. When the envelope is filled, the throat opening mechanism disengages from the upper free edge of the envelope, and an ejection mechanism engages the envelope to withdraw it from the inserting machine and deposit it in a suitable receptacle or conveyor for further processing.

In heretofore known envelope inserting machines, the mechanism for conveying the envelopes from the storage location to the inserting location, and the ejection mechanism which withdraws the filled envelopes from the inserting machine, have each been driven by separate drive means operated by separate sources of power. For example, the conveying mechanism typically included a series of feed rollers and cooperating back up rollers mounted on shafts, one of which was typically driven by means of belts and pulleys from a suitable electric motor. Similarly, the ejection mechanism also consisted of a plurality of feed rollers and cooperating back up rollers mounted on shafts, again one of which was typically driven by means of belts and pulley from another electric motor.

In order for the envelopes to be conveyed from the storage location to the inserting location, held thereat while the insert material was being inserted by the inserting mechanism, and then be withdrawn from the inserting machine by the ejection mechanism, all in rapid sequence, some form of timing control was provided so that a succeeding envelope could be conveyed from the storage location to the insert location while a preceding envelope was being withdrawn from the inserting machine. The timing of operation of these individual mechanisms was critical to smooth operation of the inserting machine, for the reason that if any one of these mechanisms either commenced or ceased operation either before or after a critical time, a jam would occur in the machine which almost invariably caused the machine to cease operation until an operator could clear the jammed envelope and insert material package. In view of the fact, as stated above, that these machines are most typically used in large volume mailing operations where speed and continuity of operation are extremely important to maintaining a cost effective operation, it is apparent that proper timing of operating periods of the individual mechanisms of the inserting machine is of major importance.

Thus, there is a need for an improvement in the envelope ejection mechanisms of known inserting machines which eliminates the necessity for providing any form of control device or instrumentality for maintaining critical timing control over the various mechanisms utilized in the inserting machines for performing the above described functions which will effectively eliminate the forgoing problems.

BRIEF SUMMARY OF THE INVENTION

The envelope ejection mechanism of the present invention is intended to fill the foregoing need by providing an ejection mechanism which at greatly obviates if not entirely eliminates the above stated problems associated with the ejection mechanisms in currently available inserting machines by providing an ejection mechanism which is mechanically coupled to the envelope positioning and throat opening mechanisms of the inserting machine so as to operate in synchronism with those mechanisms.

Thus, in its broader aspects, the envelope ejection mechanism of the present invention is utilized in an envelope inserting machine which has means for feeding envelopes seriatim in one direction along a feed path to and through an inserting station, and means for incrementally moving the envelopes in the reverse direction through the inserting station until they reach an insert receiving position. There are means disposed at the inserting station for opening the throats of the envelopes when they are at the insert receiving position to permit insert material to be inserted into the envelopes by an inserting mechanism, and means for driving the throat opening means through successive cycles of operation in synchronism with the reverse direction incremental movement of the envelopes to the insert receiving position. Within this environment, the envelope ejecting mechanism of the present invention comprises means for ejecting the envelopes from the insert receiving position after the insert material has been inserted thereinto, means connecting the envelope ejecting means to the means for driving the throat opening means and the means for incrementally moving the envelopes in the reverse direction, and control means operatively interconnected between the envelope throat opening means and the envelope ejecting means for preventing the envelope ejecting means from ejecting an envelope until it is positioned at the insert receiving position and insert material has been inserted thereinto, whereby the envelope ejecting means is driven in synchronism with the operation of the envelope throat opening means and the incremental reverse movement of the envelopes to the insert receiving position to prevent envelopes from being ejected prior to insert material being inserted thereinto.

In some of its more specific aspects, the envelope ejecting means comprises feeding means disposed in the path of movement of the envelopes adjacent the closed end of the envelopes for alternately engaging with and disengaging from the envelopes, the feeding means preferably being a pair of back up rollers mounted for limited reciprocatory movement toward and away from a pair of feed rollers to pinch envelopes with insert material therein therebetween to eject the envelope. The back up rollers are moved by a cam mechanism which is driven in synchronism with the means for opening the throats of the envelopes, and there is a microprocessor control for preventing the ejecting means for operating until an envelope actually receives the insert material.

Having briefly described the general nature of the present invention, it is a principal object thereof to provide an envelope ejecting mechanism which operates in mechanically timed relationship with an envelope positioning and throat opening apparatus so as to avoid the necessity for providing an independent timing control for the envelope ejecting mechanism.

It is another object of the present invention to provide an envelope ejecting mechanism which operates through continuous cycles of envelope ejecting operation but yet which cannot eject an envelope until it is properly filled with a package of insert material.

These and other objects and advantages of the present invention will become more apparent from an understanding of the following detailed description of a presently preferred mode of carrying out the invention when considered in conjunction with the accompanying drawings.

DETAILED DESCRIPTION OF THE INVENTION

Figure 1:
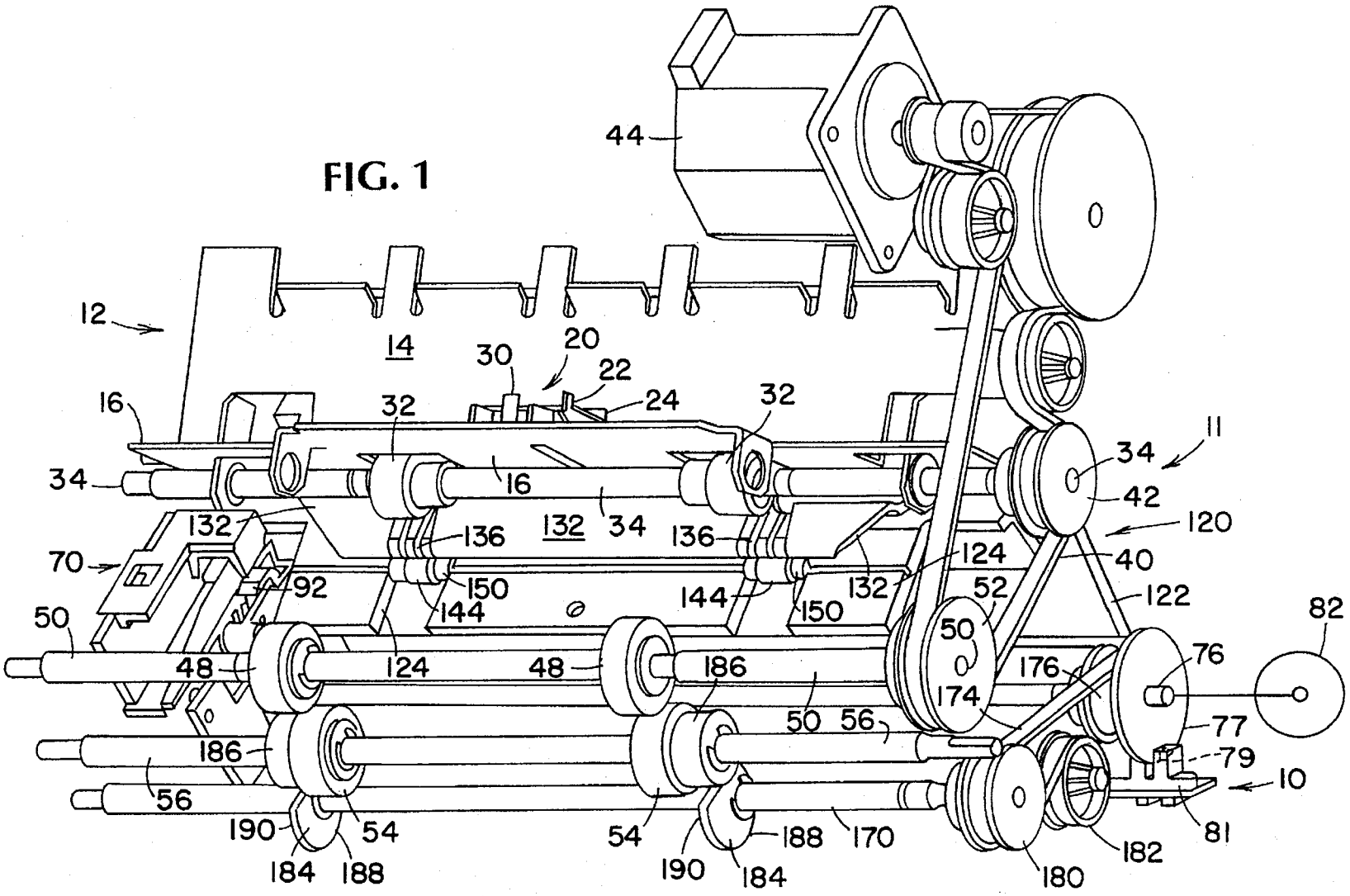
FIG. 1 is a perspective view of only so much of an envelope inserting machine as is necessary to illustrate the envelope positioning mechanism and the envelope ejection mechanism of the present invention.
Figure 2:
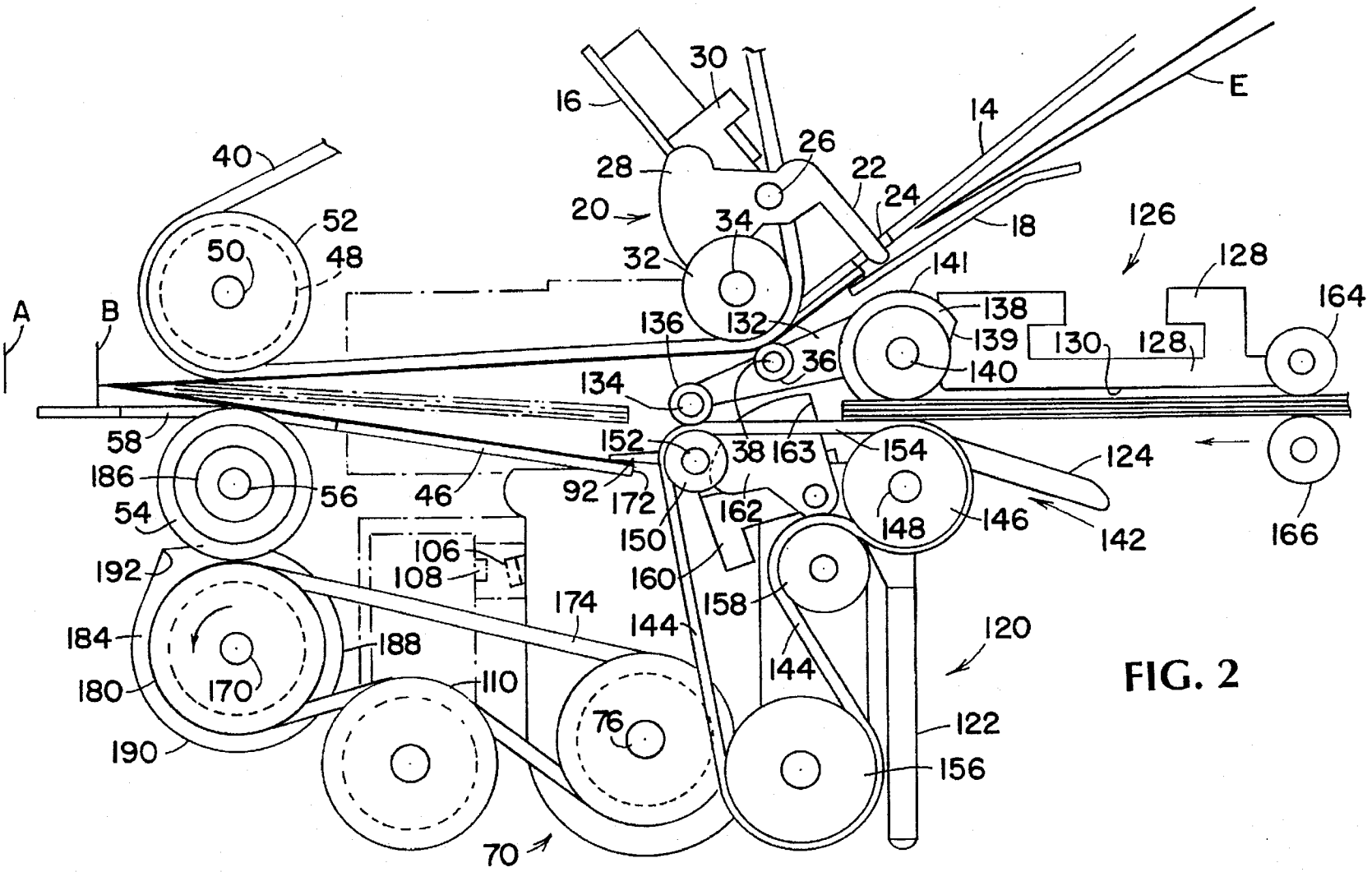
FIG. 2 is a side view of the mechanism shown in FIG. 1, showing an envelope being fed into the throat opening and positioning mechanism, and insert material being inserted into an envelope previously positioned for receiving insert material.

Referring now to the drawings, and particularly to FIGS. 1 and 2 thereof, the envelope ejection mechanism of the present invention, designated generally by the reference numeral 10, is illustrated in conjunction with an envelope positioning mechanism, designated generally by the reference numeral 11, which itself is a major component of an inserting machine which includes other features not pertinent to the present invention. It will be understood that all of the structure hereinafter described is suitably mounted in a frame forming part of the inserting machine, and only so much of the structure of the inserting machine as is necessary to an understanding of the present invention is included herein.

A generally V-shaped guide plate, designated generally by the reference numeral 12, is suitably mounted on the frame, the guide plate 12 having a first slanted wall 14 which forms part of a feed path for envelopes being fed through the envelope positioning mechanism 11, and a second slated wall 16 which provides suitable support for certain control elements hereinafter fully described. Another guide plate 18 (FIG. 2) is mounted beneath the wall 14 of the guide plate 12 and in spaced relationship therewith, such that the wall 14 and the wall 18 define part of a feed path into which envelopes, such as represented by the envelope E in FIG. 2, are fed in succession. It will be understood, as is well known in the art, that the inserting machine has means for feeding individual envelopes from a supply thereof, and for opening the flaps of the envelopes prior to their being fed into the inserting area of the inserting machine. Thus, the envelopes, as represented by that designated E in FIG. 2, have already been fed through the initial feeding means of the inserting machine and the flaps of the envelopes have been opened.

A sensing switch, designated generally by the numeral 20, is mounted on the wall 16 of the guide member 12, and includes an envelope sensing lever 22 which projects downwardly through an aperture 24 in the wall 14 to as to be disposed in the path of movement of the envelope E. The sensing lever 22 is pivotally mounted, as at 26, so that an arm 28 thereof is moved upwardly toward a switch 30 which is activated to a closed position by clockwise movement of the sensing lever 22 when an envelope E moves past the lower end of the sensing lever 22. As further explained below, the function of the sensing lever 22 and the switch 30 is to initiate operation of a microprocessor control means for positioning the envelope E in a desired insert receiving position to enable a throat opening device hereinafter described to open the throat of the envelope E.

A pair of feed rollers 32 are fixedly mounted on a shaft 34 for rotation therewith, and a pair of back up rollers 36 (FIG. 2) are rotatably mounted on a shaft 38 fixedly mounted in the frame. The shaft 34 is driven by a belt 40 which passes around a pulley 42 fixedly mounted on one end of the shaft 34, the belt 42 being driven by a stepper motor 44, the belt 40 also driving other components as further explained hereinbelow.

Another guide plate 46 is mounted slightly beneath and spaced in the downstream direction of an envelope E so that the lead edge of the envelope engages the guide plate 46 as the envelope is fed along the feed path defined thus far by the walls 14 and 18 and the feed rollers 32 and back up rollers 36. A pair of feed rollers 48 are fixedly mounted on a shaft 50 which is rotatably driven by the belt 40 passing around a pulley 52. A pair of back up rollers 54 are rotatably mounted on a shaft 56 which is suitably mounted in the inserting machine frame for limited vertical movement, the back up rollers 54 projecting upwardly through apertures 58 in the guide plate 46 to engage with the feed rollers 48 when the shaft 56 is in an upper position. The feed rollers 48 and backup rollers 54 and the supporting shafts 50 and 56 respectively are part of the envelope ejection mechanism 10 of the present invention, further structure and operation of which are described hereinbelow.

Referring now to FIGS. 2 through 5, a pair of envelope throat opening devices, designated generally by the reference numeral 70, are mounted on opposite sides of and generally beneath the plate 46 adjacent the upstream end thereof and beneath and slightly downstream of the feed rollers 32 and back up rollers 36. The throat opening devices 70 function to engage the upper edge of the rear or non flapped surface of an envelope and draw that edge downwardly while the upper surface and the flap of the envelope are maintained in an upper position, thereby opening the throat to permit insert material to be inserted into the envelope as seen in FIG. 2 and now to be fully described. The envelope throat opening devices 70 each include a housing 72 (FIG. 3) which encloses a driving gear 74 fixedly mounted on a shaft 76 which is journaled for rotation in the housing 72, the shaft 76 extending outside of the housing 72 on one side thereof (FIG. 1 ) and which is driven by a suitable stepper motor diagramatically shown at 82. The housing 72 also encloses a driven gear 84 which is rotatably mounted on a suitable bearing 86 such that the driven gear 84 meshes with the driving gear 74. An encoder wheel 77 is mounted on the shaft 76 adjacent the outer end thereof, the wheel 77 having a slot 79 thereon which passes between the light source and photocell of an optical sensor 81 to designate a home position of the envelope throat opening devices 70 when they have fully opened the throat of an envelope, as more fully explained below. Also, the function of the encoder wheel 77 is further explained below in conjunction with the description of the operation of the envelope ejection mechanism 10.

One end of an elongate link 88 is pivotally mounted on a pin 90 carried eccentrically by the gear 84, and the other end of the link 88 carries a hook 92 that is bent over at almost a right angle to the long dimension of the link 88. One end of a lever 94 is pivotally mounted on a pin 96 mounted on an intermediate portion of the link 88, the other end of the lever 94 being pivotally connected to another pin 98 which passes through a slot 100 formed in a switch actuator plate 103 which is also mounted in the housing 72. The switch actuator plate 103 is pivotally mounted on a pin 104 also connected to the housing 72.

Figure 3:
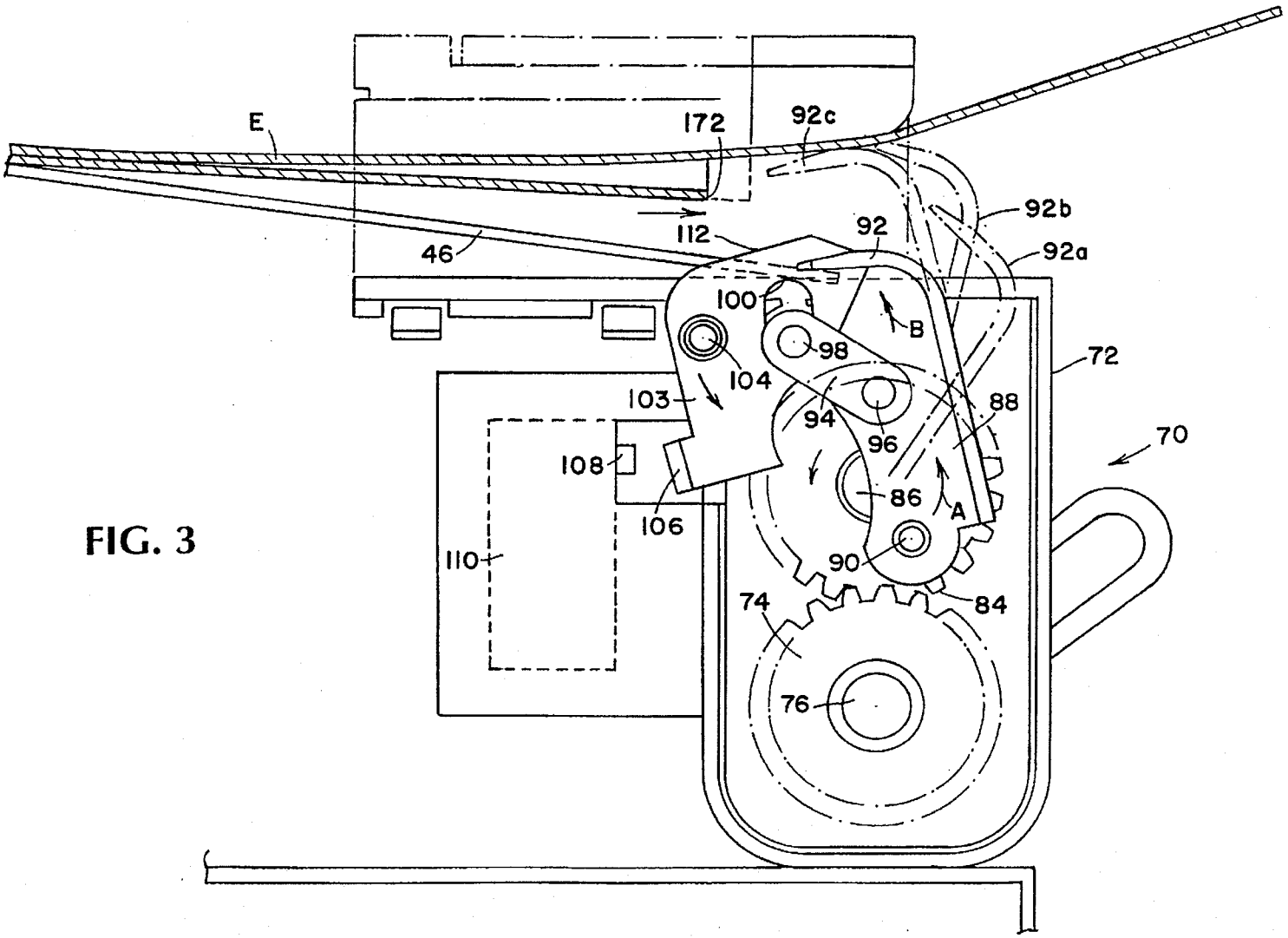
FIG. 3 is a view similar to FIG. 2, drawn to an enlarged scale, showing the envelope in the throat opening device and illustrating various positions of the throat opening fingers during a cycle of operation.
Figure 4:
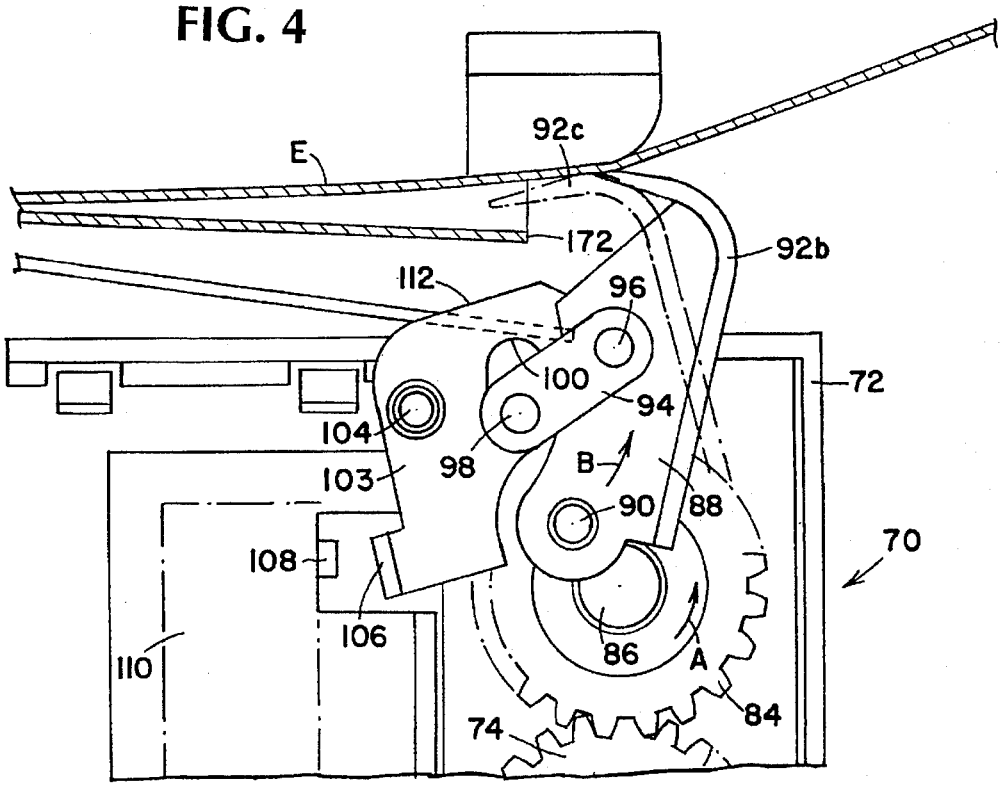
FIG. 4 is a view similar to FIG. 3, but showing the throat opening device engaged in the throat of an envelope and about to open the throat.
Figure 5:
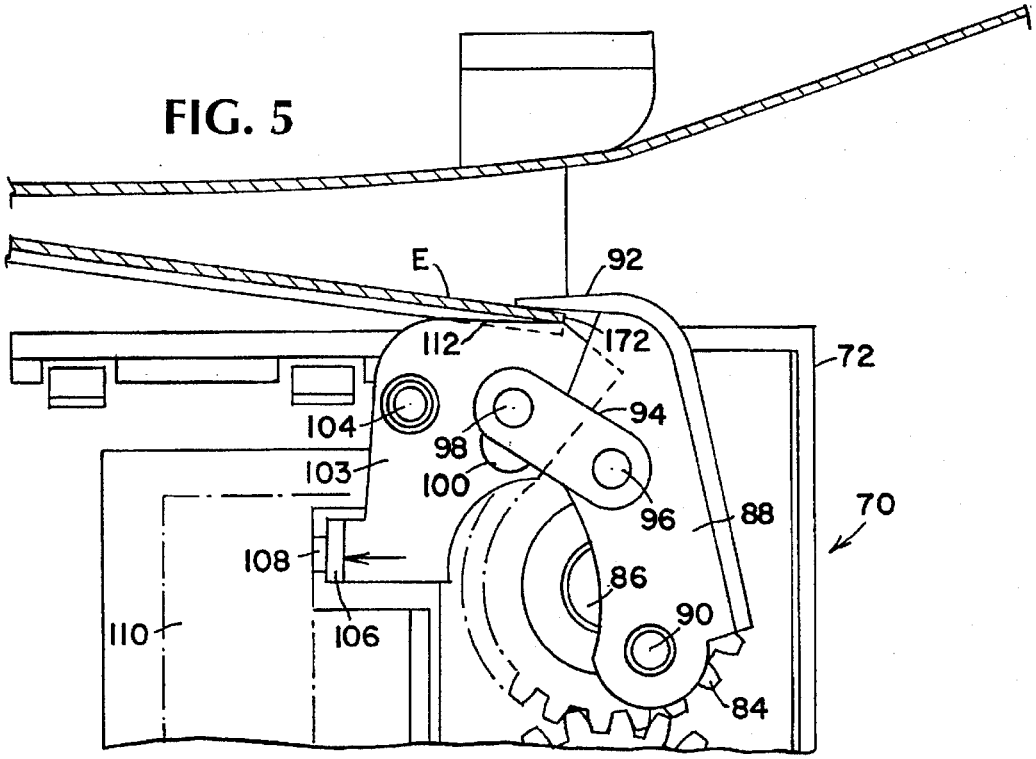
FIG. 5 is a view similar to FIG. 3, but showing the throat opening device holding the envelope throat fully open.

A partial description of the operation of the envelope throat opening device will now be presented with reference to FIGS. 3 through 5. It will be seen from FIG. 3 that when the driving gear 74 is rotated in a counter clockwise direction, the driven gear 84 is rotated in a clockwise direction, and the pin 90 follows an orbital path around the shaft 86 as indicated by the arrow A. Rotation of the pin 90 causes the lower end of the link 88 to follow the same orbital path as the pin 90, but since the link 88 is connected by the pin 96 to the lever 94, which in turn is connected to the housing 72 by the pin 98, the pin 96 also follows an orbital path as indicated by the arrow B, and the link 88 is initially oscillated in a clockwise direction about the pin 90 as it moves upwardly from the position shown in FIG. 3 to cause the hook 92 to move from the solid line position to the first dotted line position indicated by the numeral **92*a*. Further rotation of the gear 84 causes the pins 90 and 96 to reach substantially uppermost positions, as shown in FIG. 4, which causes the link 94 to reach its uppermost position to bring the hook 92 to the second dotted line position 92*b* shown in FIG. 3 and the solid line position 92*b* shown in FIG. 4. Still further rotation of the gear 84 causes the link 88 to oscillate in a counter clockwise direction about the pin 90 which now causes the hook 92 to moved in a downstream direction with respect to the movement of envelopes along the feed path so that the hook 92 now reaches the dotted line position 92*c* in FIGS. 3 and 4. As will be more fully explained hereinbelow, this is the position in which the hook 92 of each throat opening device 70 engages the upper edge 172 of the non-flapped side of the envelope to open the throat. As the gear 84 completes one revolution and returns to the position shown in FIG. 3, the link 88 is pulled downwardly by the pin 90 so that the hook 92 is also pulled downwardly from the dotted line position 92*c* in FIGS. 9 and 10 to the solid line position 92 in FIGS. 3 and 5. This position of the hook 92 corresponds to the above mentioned home position of the envelope throat opening device 70 and the position of the encoder wheel 77 when the slot 70 is within the optical sensor 81**.

It was mentioned previously that each throat opening device 70 include a switch actuator plate 103, the function of which is to provide a signal to the microprocessor that the hooks 92 have engaged the upper edge 172 of an envelope and opened the throat. Thus, it will be seen that the switch actuator plate 103 includes a switch engaging tab 106 disposed adjacent the lower end of the switch actuator plate 103, the function of which is to depress a movable switch arm 108 of a switch 110 when the switch actuator plate 103 is oscillated from a first position shown in FIGS. 3 and 4 in which the tab 106 is out of contact with the switch arm 108 to a second position shown in FIG. 5 in which the tab 106 is in contact with the switch arm 108 and has depressed the switch arm 108, thereby closing the switch 110. The switch actuator plate 103 includes suitable biasing means to normally maintain it in the first position shown in FIGS. 3 and 4, so that the switch 110 cannot be closed during repeated rotation of the gear 84 and oscillating cycles of the link 88 and hook 92 as explained above.

As best seen in FIG. 4, the link 88 and hook 92 are mounted on the pins 90 and 104 respectively so that they are in very close side by side relationship, with only sufficient clearance between them to permit relative side by side movement. However, the upper edge of the switch actuator plate 103 has a slanted surface 112 which is engaged by the lower surface of the upper edge 172 of an envelope E when the hooks 92 engage the opposite surface of the upper edge 172 of the envelope and pull it downwardly during the last portion of rotation of the gear 84, as explained above. This causes the switch actuator plate 103 to oscillate in a clockwise direction to move the tab 104 into contact with the switch arm 108, thereby depressing the latter to close the switch 110. Thus, the closing of the switch 110 signals the microprocessor that the throat of the envelope has been opened, as best seen in FIG. 5. It should be noted that a false signal that an envelope is properly positioned with the throat open and ready to receive insert material cannot be given to the microprocessor even if an envelope is fed onto the guide plate 46 in a skewed manner because the microprocessor requires a signal from the switch 110 in both throat opening devices 70 in order for it to recognize that an envelope is properly positioned to receive insert material.

Since the specific structure by which the package of insert material is inserted into the envelope is not a part of the present invention, it is hereinafter described only to the extent that it interacts with the present invention. Thus, as best seen in FIGS. 1 and 2, a generally T-shaped member, indicated generally by the reference numeral 120, extends across the envelope positioning apparatus 10 and is suitably mounted in the frame thereof for limited vertical movement. The T-shaped member 120 has a vertically extending web 122, and a generally horizontal upper cross piece 124 which forms a supporting surface for the insert material as hereinafter more fully explained. Another member, indicated generally by the reference numeral 126 (FIG. 2), is mounted between the envelope positioning apparatus frame, this member having an elongate rear portion 128, the under surface 130 thereof forming a guide surface for the insert material, also as hereinafter more fully explained. A pair of relatively short forwardly projecting extensions 132 support a shaft 134 on which is mounted a pair of back up rollers 136. A plurality of D-rollers 138 having insert material engaging surfaces 139 are mounted on a shaft 140 which is suitably driven under the control of the microprocessor as hereinafter described.

The T-shaped member 120 supports a pair of feeder assemblies, indicated generally by the reference numeral 142 in FIG. 2, each feeder assembly having a feed belt 144 which passes around a drive pulley 146 mounted on a shaft 148 which is suitably geared to the shaft 140 supporting the D-rollers 138, so that the pulleys 146 are driven in synchronism with the D-rollers 138. The belt 144 also passes around a pulley 150 rotatably mounted on a shaft 152 suitably mounted in each feeder assembly 142 so as to present a substantially horizontal portion 154 (FIG. 2) of the belt 144. The belt 144 also passes around a lower pulley 156, and a small adjustably mounted pulley 158 which permits tension adjustment on the belt 144. A switch 160 is provided on each of the feeder assemblies, each switch 160 having an actuator 162 pivotally mounted on the feeder assembly so as normally to have an abutment face 163 disposed in the path of movement of insert material to move the actuator 162 from a position in which the switch 160 is not actuated as shown in FIG. 2 to a position in which it is actuated. Finally, a pair of cooperating feed rollers 164 and 166 are mounted in the inserting machine component to feed the insert material to a standby position beneath the rear portion 128 of the member 126, as seen in FIG. 2.

With the parts and the insert material in the positions shown in FIG. 2, it will be seen that when the microprocessor provides an appropriate signal to the drive element for the shaft 140, the D-rollers 138 are rotated in a clockwise direction to cause the material engaging surface 139 of each roller to engage the upper surface of the insert material, thereby pressing the lower surface thereof against the upper surfaces of the belts 144 where it passes over the pulleys 146. The entire feeder assembly 142 can then move downwardly to accommodate the thickness of the insert material between the peripheral surface 141 of the D-rollers and the upper surfaces of the belts 144. The insert material then moves along the upper runs 154 of the belts 144 and between the nip of the belts 144 and the back up rollers 136, which move the insert material into the envelope E. During this movement, the switch actuators 162 move downwardly to actuate the swatches 160 and back to their normal positions after the trailing edge of the insert package passes the switch actuators 162 for a purpose fully described hereinbelow.

Referring now to FIGS. 1 and 2, the envelope ejecting mechanism 10 of the present invention, of which the rollers 48 and 54, and the shafts 50 and 56 were described earlier, further comprises a cam shaft 170 rotatably supported in the frame of the inserting machine which is driven by a timing belt 174 which passes around a pulley 176 mounted on the shaft 76 that is driven by the stepper motor 82. The timing belt 174 passes around another pulley 180 mounted on the cam shaft 170, and then around a suitable tension adjusting roller 182. Thus, it will be apparent that the shaft 76, which drives the envelope throat opening devices 70 as described above, and the cam shaft 170 are driven in synchronism for a purpose described below.

As best seen in FIG. 1, the cam shaft 170 supports a pair of cams 184, which are mounted in appropriate position to engage a pair of cam followers 186 which are mounted on the shaft 56 adjacent to the back up rollers 54. Each cam includes a dwell portion 188 of constant radius which covers approximately a 240° arc, a rise portion 190 of gradually increasing radius which covers the remaining approximately 120° arc of the cam, and a lobe portion 192 which attains maximum radius at the juncture of the minimum dwell 188 portion and maximum rise portion 190. Thus, it will be apparent that as the timing belt 174 is driven in a counter clockwise direction to drive the pulley 180 in the same direction, the cams 184 will engage the cam followers 186 with a continuously upward motion after the cams 184 have rotated sufficiently far to move the dwell portion 188 past the cam followers 186, thereby moving the shaft 56 in an upward direction to move the back up rollers 54 upwardly through the apertures 58 in the guide plate 46 until they pinch the envelope with the feed rollers 48 to eject the envelope as further described below.

Figure 6:
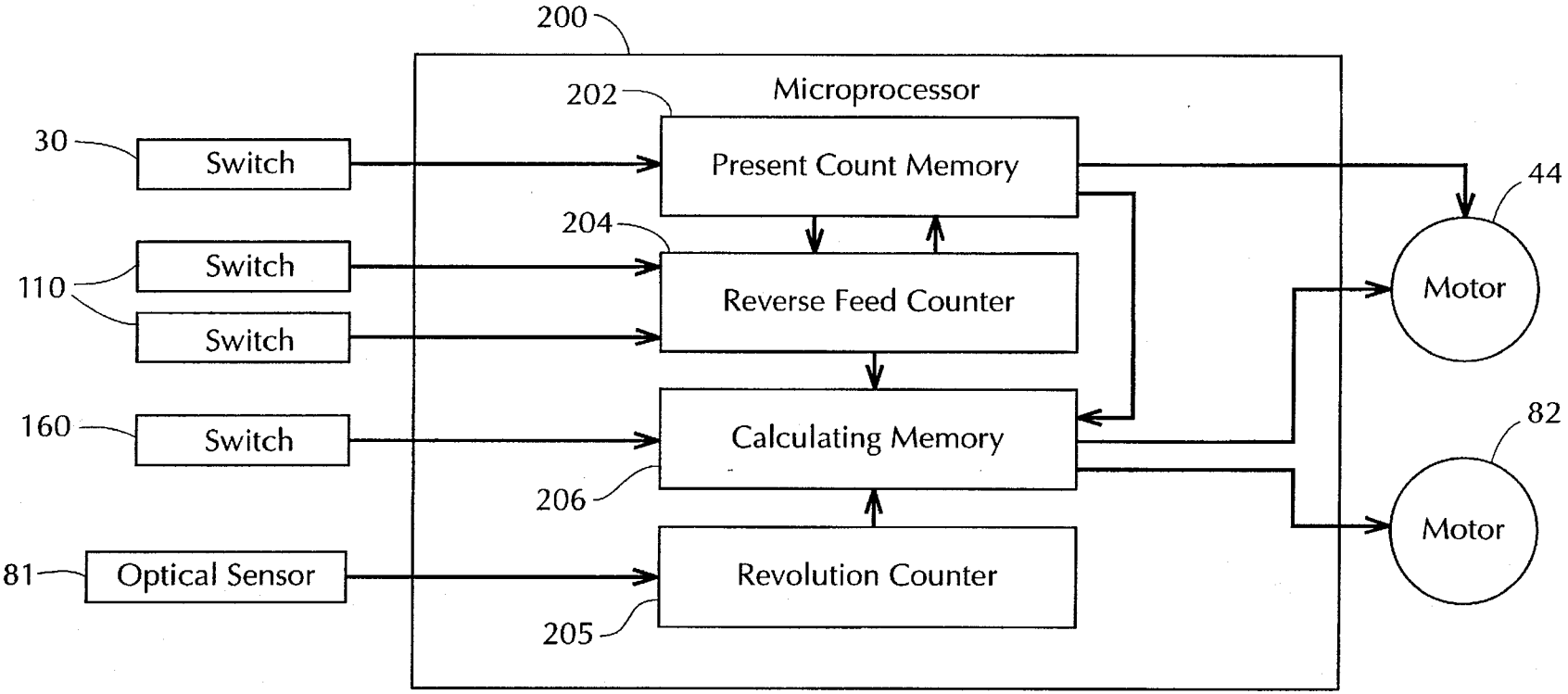
FIG. 6 is a relatively simple schematic diagram of the electrical and electronic control components of the apparatus embodying the present invention.

FIG. 6 is a relatively simple schematic diagram which illustrates the manner in which the above described switching and driving components interact through a microprocessor, indicated generally by the reference numeral 200, to control the movement of successive envelopes to dispose them at an insert receiving position, depending on the shape and throat characteristics of the envelopes, and to eject the envelopes from the inserting machine after they have received the insert material. Thus, with particular reference to FIGS. 2, 3 and 6, a complete cycle of operation of the apparatus described above commences when an envelope E is initially fed from a suitable storage device into the portion of the feed path represented by the guide plates 14 and 18, where it strikes and moves the sensing lever 22, thereby actuating the switch 30. This in turn causes the microprocessor to energize the stepper motor 44 to drive the belt 40 and feed rollers 32 to move the envelope E for a predetermined distance as controlled by a suitable preset count memory 202 in the microprocessor 200. This movement brings the lead edge of the envelope E to the position designated by the line A in FIG. 2, at which the upper edge 172 of the envelope is at a location beyond the point where the hooks 92 can engage the upper edge 172, as seen by the solid line position in FIG. 3. The predetermined distance traveled by the envelope E is represented by the number of electronic counts stored in the preset count memory 202 in the microprocessor 200, and when the stepper motor 44 has been driven by this number of counts, the microprocessor 200 stops it to arrest the movement of the envelope E.

At this moment, the microprocessor 200 also energizes the motor 82 to drive the shaft 76 to commence operation of the throat opening devices 70 as described above. Simultaneously, the shaft 76 also commences operation of the envelope ejection mechanism 10 through rotation of the pulley 176, timing belt 174, pulley 180, cam shaft 170, cams 184 and cam followers 186 to cause the shaft 56 to move upwardly toward the shaft 50, thereby causing the back up rollers 54 to momentarily engage the feed rollers 48 and pinch the envelope therebetween. At this time, the envelope E is not moved because the feed rollers 54 are stationary because the microprocessor 200 has not received a signal from the throat opening devices 70 that the throat of the envelope has been opened to receive insert material. It must be remembered that the envelope E was initially fed beyond the insert receiving position so that the hooks 92 could not engage the upper edge 172 of the envelope E to open the throat. The microprocessor 200 monitors the operation of the throat opening devices 70 through the optical sensor 81 and the switches 110 to determine whether these switches remain open when the optical sensor 81 indicates that the hooks 92 are in the home position. If the switches 110 remain open at this time, the microprocessor causes the motor 82 to drive the shaft 76 through another complete revolution. The throat opening devices 70 and the envelope ejection mechanism 10 continue to make complete cycles of operation with each revolution of the shaft 76.

Each time the throat opening devices 70 complete a cycle of operation without the switches 110 being closed, the microprocessor 200 again energizes the stepper motor 44 to feed the envelope E in a reverse direction for a short predetermined increment of movement, e.g., one sixteenth of an inch, to bring the upper edge 172 of the envelope E successively closer to the hooks 92, while the motor 82 continues to drive the shaft 76 through successive revolutions as stated above. This operation continues until the envelope E is moved in the reverse direction sufficiently far to permit the hooks 92 to enter the throat of the envelope E and engage the upper edge 172 thereof, as seen in FIG. 4, and open the throat, as seen in FIG. 5 at which point the hooks 92 and the encoder wheel 77 are in the home position; the position of the leading edge of the envelope E at this point is indicated by the line B as seen in FIG. 2, and the envelope is now in the insert receiving position, which is the optimum position of the envelope for the hooks to engage the upper edge 172 to open the throat to permit the insert material to be inserted into the envelope E. As previously described, opening the throat of the envelope E causes envelope to engage the actuator plate 103 to move in a clockwise direction to cause the switch engaging tab 106 to move the switch actuator 108 to close the switch 110. Closing of both switches 110 sends a signal to the microprocessor 70 that the envelope is now in the proper position to receive insert material.

The microprocessor 200 includes a suitable reverse feed counter 204 for recording the number of counts that the stepper motor 44 moves the envelope E in the reverse direction to bring the lead edge thereof to the line B position. Also a suitable calculating memory 206 is provided which calculates the difference between the preset number of counts in the memory 202 and the number of counts recorded by the counter 204, and stores this difference. Once the insert material is inserted into the first envelope E and it is ejected from the inserting machine, the microprocessor 200 will cause the stepper motor 44 to immediately bring all subsequent envelopes having the same size and throat characteristics as the first envelope to the position at which the hooks 92 will immediately engage the upper edge 172 and open the throat of each succeeding envelope. Thus, the microprocessor actually adjusts the preset number of counts by which the stepper motor 44 is actuated to feed the first envelope to the lead edge A position to feed subsequent similar envelopes to the lead edge B position. By subtracting the second number of counts from the preset number of counts, the microprocessor determines the number of counts which are required to bring the envelope directly to the insert receiving position.

It should be understood that during the preceding successive operations of the throat opening devices 70 to bring the envelope E from the initial advanced position to the insert receiving position, and the accompanying successive operations of the envelope ejection mechanism 10, the timing of rotation of the cam shaft 170 relative to the shaft 76, together with the particular shape of the cams 184 is such that the upward movement of the shaft 54 and back up rollers 54 to bring the back up rollers 56 into momentary envelope pinching engagement with the feed rollers 48 occurs during that part of cycle of the throat opening devices 70 when the stepper motor 44 is not operating, so that the envelope E is stationary. This is accomplished by providing the cams 184 with the substantially large dwell portion 188 which does not raise the shaft 56, thereby allowing sufficient time for activation of the stepper motor 44 to move the envelope E in the reverse direction.

Once the envelope E has been properly positioned at the insert receiving position, the microprocessor 200 activates a motor (not shown) which drives the shafts 140 and 148 in the manner described above, which in turn drives the D-roller 138, and the pulley 146 to drive the belt 144. Thus, the insert material is fed forwardly by the D-roller 138 and the flat run 154 of the belt 144 toward the throat of the envelope E until the lead edge of the insert material abuts the face 163 of the switch actuator 162 to rock the actuator 162 in a counter clockwise direction so that the insert material can pass over the actuator 162 to and into the envelope E. When the trailing edge of the insert material passes beyond the actuator 162, it rotates in a clockwise direction back to its original position, it activates the switch 160 which signals the microprocessor 200 that the insert material has been fully inserted into the envelope E. In response to this signal, the microprocessor 200 energizes the motor 82 to drive the shaft 76, which causes two functions to occur almost simultaneously. First, the shaft 76 drives the throat opening assemblies 70 as hereinabove described to raise the hook 92 off of the trailing edge 172 of the envelope E so as to release the envelope for forward movement to be ejected. The motor 82 rotates the shaft 76 through about ⅔ of a revolution to bring the hook 92 to approximately the position indicated as 92C in FIG. 3, thereby disengaging the hook 92 from the trailing edge of the envelope E.

At the same time, the rotation of the shaft 76 through the ⅔ of a revolution also rotates the pulley 176, the timing belt 174 and the pulley 180 to rotate the shaft 170 and the cams 184 through the same amount, which is approximately 240°, which is also the approximate angle of the dwell portion 188 of the cams 184. Further rotation of the shaft 76 causes the rise portion 190 of the cams 184 to move the cam followers 186 and the shaft 56 upwardly to force the back up rollers 54 into driving engagement with the feed rollers 48, with the envelope E pinched therebetween. When the lobe portion 190 of the cams 184 reach the cam followers 186, the back up rollers 54 are at their uppermost position at which they pinch the envelope E with the insert material therein against the feed rollers 48. At this point, rotation of the shaft 76 stops because the microprocessor 200 has counted the appropriate number of steps of the stepper motor 82 after operation of the switch 160 which indicates that the insert material has been fully inserted into the envelope. Thus, the hooks 92 are in the position **92*c* as shown in FIG. 3 so as to release the envelope for movement. When the microprocessor 200 has counted this number of steps, it energizes the stepper motor 44 to drive the belt 40 and the feed rollers 48 in a forward direction to eject the envelope from the ejection mechanism 10. A suitable downstream sensor (not shown) determines that the envelope has been ejected from the ejection apparatus 10, at which time the microprocessor reenergizes the motor 82 to again drive the cam shaft 170 and the cams 184 so that the back up rollers 54 are moved away from the feed rollers 40** so that another envelope can be moved into the insert receiving position and another cycle of operation as above described can commence.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

What is claimed is:

1. In an envelope inserting machine having means for feeding envelopes seriatim in one direction along a feed path to and through an inserting station, means for incrementally moving the envelopes in the reverse direction through the inserting station until they reach an insert receiving position, means disposed at said inserting station for opening the throats of the envelopes when the they are at the insert receiving position to permit insert material to be inserted into the envelopes by an inserting mechanism, and means for driving said throat opening means through successive cycles of operation in synchronism with the reverse direction incremental movement of the envelopes to the insert receiving position, an envelope ejecting mechanism for ejecting envelopes from the inserting machine, said envelope ejecting mechanism comprising:

A. means for ejecting the envelopes from the insert receiving position after the insert material has been inserted thereinto, B. means connecting said envelope ejecting means to said means for driving said throat opening means and said means for incrementally moving said envelopes in said reverse direction, and C. control means operatively interconnected between said envelope throat opening means and said envelope ejecting means for preventing said envelope ejecting means from ejecting an envelope until it is positioned at said insert receiving position and insert material has been inserted thereinto, whereby said envelope ejecting means is driven in synchronism with the operation of said envelope throat opening means and the incremental reverse movement of the envelopes to the insert receiving position to prevent envelopes from being ejected prior to insert material being inserted thereinto.

2. An envelope ejecting mechanism as set forth in claim 1 wherein said means for ejecting the envelopes comprises feeding means disposed in the path of movement of the envelopes to and from said inserting station in a position adjacent the closed edge of the envelopes when disposed at the insert receiving position, said feeding means being operable to alternately engage with and disengage from envelopes disposed at said insert receiving position.

3. An envelope ejecting mechanism as set forth in claim 2 wherein said feeding means comprises feed rollers mounted on a first shaft, cooperating back up rollers mounted on a second shaft, means mounting said second shaft for limited movement toward and away from said first shaft, and means for moving said second shaft relative to said first shaft to cause said back up rollers alternately to engage with and disengage from said feed rollers.

4. An envelope ejecting mechanism as set forth in claim 3 wherein said means for moving said second shaft relative said first shaft comprises actuating means operatively associated with said second shaft for imparting limited reciprocatory movement to said second shaft.

5. An envelope ejecting mechanism as set forth in claim 4 wherein said means operatively associated with said second shaft for imparting limited reciprocatory movement thereto comprises a third shaft mounted in adjacent parallel relationship to said second shaft, cam means mounted on said third shaft, cam follower means mounted on said second shaft in operative engagement with said cam means, and means for rotating said third shaft to cause said cam means to move said cam follower means and said second shaft relative to said first shaft.

6. An envelope ejecting mechanism as set forth in claim 5 wherein said means for rotating said third shaft comprises means interconnecting said third shaft with said means for driving said envelope throat opening means for synchronous movement therewith.

7. An envelope ejecting mechanism as set forth in claim 6 wherein said connecting means comprises means connecting said third shaft with said means for driving said throat opening means whereby said third shaft and said cams are driven in synchronism with said throat opening means such that said third shaft and said cams make a complete revolution with each cycle of said throat opening means.

8. An envelope ejecting mechanism as set forth in claim 7 wherein said cams are provided with A. a relatively long dwell portion which allows said third shaft to rotate through a major portion of a revolution before said cams act on said cam followers to lift said second shaft to move said back up rollers into contact with said feed rollers, and B. a relatively short rise portion disposed between said dwell portion and a lobe portion at which said cam followers and said second shaft are moved to their maximum positions toward said first shaft to bring said back up rollers into contact with said feed rollers.

9. An envelope ejecting mechanism as set forth in claim 8 wherein said control means comprises A. first sensing means operatively associated with said envelope throat opening means for sensing the presence of an envelope at said insert receiving position with said throat opening means holding the throat of the envelope fully open, B. second sensing means operatively associated with said insert material inserting mechanism for sensing when the insert material has been fully inserted into the envelope, and C. means responsive to said first and second sensing means for preventing said envelope ejecting means from ejecting an envelope until said first and second sensing means indicate the presence of an envelope at said insert receiving position with the throat thereof open and the insert material inserted thereinto.

10. An envelope ejecting mechanism as set forth in claim 9 wherein said means responsive to said first and second sensing means for preventing said envelope ejecting means from ejecting an envelope comprises said first and second sensing means being switches interposed in a circuit to a motor which drives said envelope feeding means and which prevents said motor from operating until said switches are closed by the presence of an envelope at said insert receiving position with its throat held open and the insert material disposed within the envelope.

* * * * *